US006708741B1

(12) United States Patent
Berry et al.

(10) Patent No.: US 6,708,741 B1
(45) Date of Patent: Mar. 23, 2004

(54) BEVERAGE DISPENSER

(75) Inventors: Martin F. Berry, Raynham, MA (US); Gorm Bressner, Providence, RI (US); Detlef Westphalen, Roslindale, MA (US); Zebulon S. Robbins, III, Duxbury, MA (US); David Beittel, Arlington, MA (US); Bill Wright, Wakefield, MA (US)

(73) Assignee: Ocean Spray Cranberries, Inc., Lakeville-Middleboro, MA (US)

( * ) Notice: Subject to any disclaimer, the term of this patent is extended or adjusted under 35 U.S.C. 154(b) by 0 days.

(21) Appl. No.: 09/645,266

(22) Filed: Aug. 24, 2000

(51) Int. Cl.[7] ..... B65B 1/04; B65B 3/00; B67C 3/00

(52) U.S. Cl. ..... 141/362; 141/351; 141/361

(58) Field of Search ..... 141/351, 360, 141/362; 222/129.1, 146.6, 185.1, 325, 506, 509, 518, 545, 559; 62/389, 391

(56) References Cited

U.S. PATENT DOCUMENTS

| | | | | |
|---|---|---|---|---|
| 307,562 | A | | 11/1884 | Matthews et al. |
| 404,192 | A | | 5/1889 | Haas |
| 1,454,340 | A | | 5/1923 | Schutt |
| 1,526,101 | A | | 2/1925 | Sund |
| 1,954,986 | A | | 4/1934 | Carlson et al. |
| 2,519,115 | A | | 8/1950 | Costakos |
| 2,590,177 | A | | 3/1952 | Hopwood |
| 3,269,606 | A | | 8/1966 | Armstrong |
| 3,442,486 | A | | 5/1969 | Serio, Jr. |
| 3,753,442 | A | | 8/1973 | Tauber |
| 3,765,577 | A | | 10/1973 | Burns, Jr. |
| 3,923,288 | A | | 12/1975 | King |
| 3,941,355 | A | | 3/1976 | Simpson |
| 4,138,092 | A | * | 2/1979 | Apellaniz ..... 251/325 |
| 4,158,376 | A | | 6/1979 | Erb |
| 4,161,971 | A | | 7/1979 | Arzberger et al. |
| 4,181,143 | A | | 1/1980 | Fallon |
| 4,210,262 | A | * | 7/1980 | Donaldson ..... 141/362 |
| 4,304,341 | A | | 12/1981 | Shirley |
| 4,316,557 | A | | 2/1982 | Benoun et al. |
| 4,362,028 | A | | 12/1982 | Armstrong |
| 4,370,062 | A | | 1/1983 | Moody |
| 4,437,315 | A | | 3/1984 | Rica et al. |
| D273,654 | S | | 5/1984 | Sedam et al. |
| 4,486,213 | A | | 12/1984 | Lentz et al. |
| 4,505,409 | A | | 3/1985 | Armstrong |
| D280,880 | S | | 10/1985 | Schweres |
| 4,549,675 | A | | 10/1985 | Austin |
| D281,568 | S | | 12/1985 | Bruffey, Jr. et al. |

(List continued on next page.)

FOREIGN PATENT DOCUMENTS

| | | |
|---|---|---|
| AU | B-84792/82 | 11/1981 |
| DE | 0272245 | 1/1991 |
| DE | 0602627 A1 | 6/1994 |
| FR | 2611581 | 9/1988 |
| FR | 2744996 | 8/1997 |
| FR | 2773776 | 7/1999 |

(List continued on next page.)

OTHER PUBLICATIONS

Vinistyles, Cooling Cabinet 1 x 10 L Direct Dispense, Vinistyles 32, rue, rue Eble–49000 Angers, France, Vinistyles/lyon@wanadoo,fr.

*Primary Examiner*—Timothy L. Maust
(74) *Attorney, Agent, or Firm*—Fish & Richardson P.C.

(57) ABSTRACT

In embodiments a beverage dispenser includes a beverage cabinet, a mechanically operable, gravity-fed piston valve that can be controllably opened and closed to dispense beverage in a generally downward direction, a valve actuator supported on the cabinet below the valve and coupled to the valve and a beverage flow path to direct beverage from the valve to a receptacle.

33 Claims, 14 Drawing Sheets

U.S. PATENT DOCUMENTS

| | | | |
|---|---|---|---|
| D282,342 | S | 1/1986 | Saunders et al. |
| 4,574,986 | A | 3/1986 | Baris et al. |
| 4,582,295 | A | 4/1986 | Kugler et al. |
| D284,159 | S | 6/1986 | Crosby et al. |
| D284,926 | S | 8/1986 | Sedam et al. |
| 4,610,145 | A | 9/1986 | Arzberger et al. |
| 4,615,466 | A | 10/1986 | Credle, Jr. |
| 4,658,872 | A | 4/1987 | Ellis |
| 4,674,656 | A | 6/1987 | Wiley et al. |
| 4,678,104 | A | 7/1987 | Pritchett |
| D293,923 | S | 1/1988 | Faerber et al. |
| 4,722,463 | A | 2/1988 | Anderson |
| 4,725,110 | A | 2/1988 | Glenn et al. |
| 4,732,300 | A | 3/1988 | Valiyee et al. |
| D295,821 | S | 5/1988 | Stembridge et al. |
| 4,741,355 | A | 5/1988 | Credle, Jr. et al. |
| D296,408 | S | 6/1988 | Gaunt et al. |
| 4,750,645 | A | 6/1988 | Wilson et al. |
| 4,757,919 | A | 7/1988 | Smazik et al. |
| 4,757,920 | A | 7/1988 | Harootian, Jr. et al. |
| 4,765,152 | A | 8/1988 | Armstrong |
| 4,773,313 | A | 9/1988 | Anson |
| 4,773,571 | A | 9/1988 | Hagan et al. |
| D298,005 | S | 10/1988 | Southernwood |
| 4,784,297 | A | 11/1988 | Katz |
| 4,800,935 | A | 1/1989 | Buchser et al. |
| 4,811,872 | A | 3/1989 | Boyd |
| D301,672 | S | 6/1989 | Schechter et al. |
| D302,369 | S | 7/1989 | Schechter et al. |
| 4,854,655 | A | 8/1989 | Saunders et al. |
| 4,856,676 | A | 8/1989 | Emody |
| 4,866,945 | A | 9/1989 | Bender et al. |
| D304,407 | S | 11/1989 | Fossella |
| D304,413 | S | 11/1989 | Schecter et al. |
| 4,881,380 | A | 11/1989 | Mrugala et al. |
| 4,887,740 | A | 12/1989 | Smith |
| 4,890,642 | A | 1/1990 | Smazik et al. |
| 4,898,303 | A | 2/1990 | Large et al. |
| 4,903,935 | A | 2/1990 | Mrugala et al. |
| 4,907,725 | A | 3/1990 | Durham |
| 4,913,713 | A | 4/1990 | Bender et al. |
| 4,916,910 | A | 4/1990 | Schroeder |
| 4,921,135 | A | 5/1990 | Pleet |
| 4,921,139 | A | 5/1990 | Fischer et al. |
| 4,928,853 | A | 5/1990 | Isham et al. |
| 4,930,666 | A | 6/1990 | Rudick |
| 4,932,561 | A | 6/1990 | Boxall |
| D309,232 | S | 7/1990 | Valiyee et al. |
| D309,395 | S | 7/1990 | Thompson et al. |
| 4,946,135 | A | 8/1990 | Yang |
| 4,951,719 | A | 8/1990 | Wiley et al. |
| D311,844 | S | 11/1990 | Chase et al. |
| D312,021 | S | 11/1990 | Mohat |
| 4,974,500 | A | 12/1990 | Boyd et al. |
| D313,331 | S | 1/1991 | Schroeder et al. |
| 4,986,448 | A | 1/1991 | Takahashi et al. |
| 4,986,449 | A | 1/1991 | Valiyee et al. |
| 4,993,604 | A | 2/1991 | Gaunt et al. |
| 5,000,348 | A | 3/1991 | Emody |
| D316,005 | S | 4/1991 | Thompson et al. |
| 5,020,303 | A | 6/1991 | Vokins |
| 5,042,692 | A | 8/1991 | Valiyee et al. |
| D320,524 | S | 10/1991 | Schechter |
| 5,088,625 | A | 2/1992 | Farber et al. |
| D324,319 | S | 3/1992 | Faeber et al. |
| D324,795 | S | 3/1992 | Hoover et al. |
| D325,843 | S | 5/1992 | Ratzlaff |
| D326,385 | S | 5/1992 | Miller et al. |
| 5,114,047 | A | 5/1992 | Baron et al. |
| RE33,943 | E | 6/1992 | Arzberger et al. |
| 5,121,855 | A | 6/1992 | Credle, Jr. |
| 5,129,549 | A * | 7/1992 | Austin ..... 222/129.1 |
| 5,129,581 | A | 7/1992 | Braun et al. |
| 5,164,218 | A | 11/1992 | Tsuruta et al. |
| D332,200 | S | 1/1993 | Credle, Jr. |
| D333,405 | S | 2/1993 | Moyer, Jr. et al. |
| 5,186,359 | A | 2/1993 | Brown et al. |
| 5,190,188 | A | 3/1993 | Credle, Jr. |
| D334,863 | S | 4/1993 | Phillips et al. |
| 5,201,459 | A | 4/1993 | Bettle, Jr. et al. |
| 5,203,474 | A | 4/1993 | Haynes |
| 5,209,069 | A | 5/1993 | Newnan |
| D336,012 | S | 6/1993 | Wiley et al. |
| 5,217,288 | A | 6/1993 | Johnson |
| 5,230,278 | A | 7/1993 | Bunn et al. |
| 5,234,131 | A | 8/1993 | Griffin |
| 5,235,659 | A | 8/1993 | Atkins et al. |
| D340,616 | S | 10/1993 | Williams et al. |
| D343,332 | S | 1/1994 | Schroeder et al. |
| 5,275,309 | A | 1/1994 | Baron et al. |
| 5,287,427 | A | 2/1994 | Atkins et al. |
| 5,314,091 | A | 5/1994 | Credle, Jr. |
| 5,325,998 | A | 7/1994 | Bennett |
| 5,326,998 | A | 7/1994 | Jun |
| 5,327,515 | A | 7/1994 | Anderson et al. |
| 5,327,941 | A | 7/1994 | Bitsakis et al. |
| 5,333,759 | A | 8/1994 | Deering |
| 5,341,957 | A | 8/1994 | Sizemore |
| 5,348,192 | A | 9/1994 | Sardynski et al. |
| 5,348,217 | A | 9/1994 | Bettle, Jr. et al. |
| 5,350,085 | A | 9/1994 | Kidd et al. |
| 5,351,861 | A | 10/1994 | Jovellana |
| 5,353,963 | A | 10/1994 | Gorski et al. |
| D351,965 | S | 11/1994 | Credle, Jr. |
| 5,363,671 | A | 11/1994 | Forsythe et al. |
| 5,372,014 | A | 12/1994 | Adams |
| 5,377,878 | A | 1/1995 | Rainey et al. |
| 5,383,581 | A | 1/1995 | LeMarbe et al. |
| 5,385,273 | A | 1/1995 | Eddy et al. |
| D356,713 | S | 3/1995 | Groover |
| 5,397,032 | A | 3/1995 | Landers |
| 5,415,326 | A | 5/1995 | Durham et al. |
| D359,874 | S | 7/1995 | Smith et al. |
| 5,437,395 | A | 8/1995 | Bull et al. |
| 5,443,183 | A | 8/1995 | Jacobson et al. |
| 5,444,992 | A | 8/1995 | Bell |
| D362,581 | S | 9/1995 | Rogers |
| 5,456,387 | A | 10/1995 | Trewhella |
| 5,462,168 | A | 10/1995 | Oberhelman et al. |
| 5,462,201 | A | 10/1995 | Wilkins |
| 5,477,883 | A | 12/1995 | Totten |
| 5,478,371 | A | 12/1995 | Lemaire et al. |
| D367,585 | S | 3/1996 | Piatnik et al. |
| D367,989 | S | 3/1996 | Mill et al. |
| 5,499,744 | A | 3/1996 | Hawkins |
| 5,500,031 | A | 3/1996 | Atkins et al. |
| D368,617 | S | 4/1996 | Jackson et al. |
| 5,507,415 | A | 4/1996 | Sizemore |
| 5,524,864 | A | 6/1996 | Dubach |
| D371,713 | S | 7/1996 | Credle, Jr. |
| 5,537,838 | A | 7/1996 | Mills et al. |
| D372,393 | S | 8/1996 | Credle, Jr. |
| D372,831 | S | 8/1996 | Credle, Jr. |
| 5,542,572 | A | 8/1996 | Davis |
| 5,542,584 | A | 8/1996 | Konar |
| 5,559,907 | A | 9/1996 | Inniss et al. |
| D375,431 | S | 11/1996 | Credle, Jr. et al. |
| 5,570,822 | A | 11/1996 | LeMarbe et al. |
| 5,575,405 | A | 11/1996 | Stratton et al. |
| D377,289 | S | 1/1997 | Credle, Jr. |
| 5,603,432 | A | 2/1997 | Sardynski et al. |
| 5,607,211 | A | 3/1997 | Henninger et al. |

5,620,495 A 4/1997 Aspell et al.
D379,284 S 5/1997 Credle, Jr.
5,651,482 A 7/1997 Sizemore
5,664,436 A 9/1997 Hawkins, Jr. et al.
5,673,817 A 10/1997 Mullen et al.
5,673,820 A 10/1997 Green et al.
5,683,015 A * 11/1997 Lee ..... 222/146.6
D389,368 S 1/1998 Parks et al.
D389,693 S 1/1998 Hawkins, Jr. et al.
D389,694 S 1/1998 Vinson
5,743,106 A 4/1998 Lee
5,752,624 A 5/1998 Vinson et al.
5,775,364 A 7/1998 Erb
5,791,523 A 8/1998 Oh
5,797,519 A 8/1998 Schroeder et al.
5,803,312 A 9/1998 Credle, Jr. et al.
5,836,481 A 11/1998 Strohmeyer et al.
5,839,291 A 11/1998 Chang
5,873,259 A 2/1999 Spillman
5,890,626 A 4/1999 Wolski et al.
5,931,348 A 8/1999 Guadalupi
5,938,077 A 8/1999 Erb
5,960,997 A 10/1999 Forsythe
5,965,876 A 10/1999 Anemogiannis et al.
5,974,825 A 11/1999 Simmons et al.
5,992,685 A 11/1999 Credle, Jr.
5,996,842 A 12/1999 Riley et al.
D418,365 S 1/2000 Ford
6,029,562 A 2/2000 Sintchak
6,039,219 A * 3/2000 Bach et al. ..... 141/362
6,041,970 A 3/2000 Vogel
6,056,157 A 5/2000 Gehl et al.

FOREIGN PATENT DOCUMENTS

GB 2045211 A 10/1980
GB 0738491 A2 10/1996
GB 0780644 A2 6/1997
WO WO92/03347 3/1992
WO WO96/31403 10/1996
WO WO97/34826 9/1997
WO WO97/35802 10/1997
WO WO/97/41058 11/1997
WO WO98/19958 5/1998
WO WO00/09437 2/2000
WO WO00/15543 3/2000

* cited by examiner

Balance Moments Around Pivot (Ignore Gravity)

$$F_C\ (9.22 - 1.68 - 0.625) = F_V\ (1.85 - 0.37 - 3.75)$$

$$\frac{F_C}{F_V} = \frac{1.105}{6.915} = 0.16$$

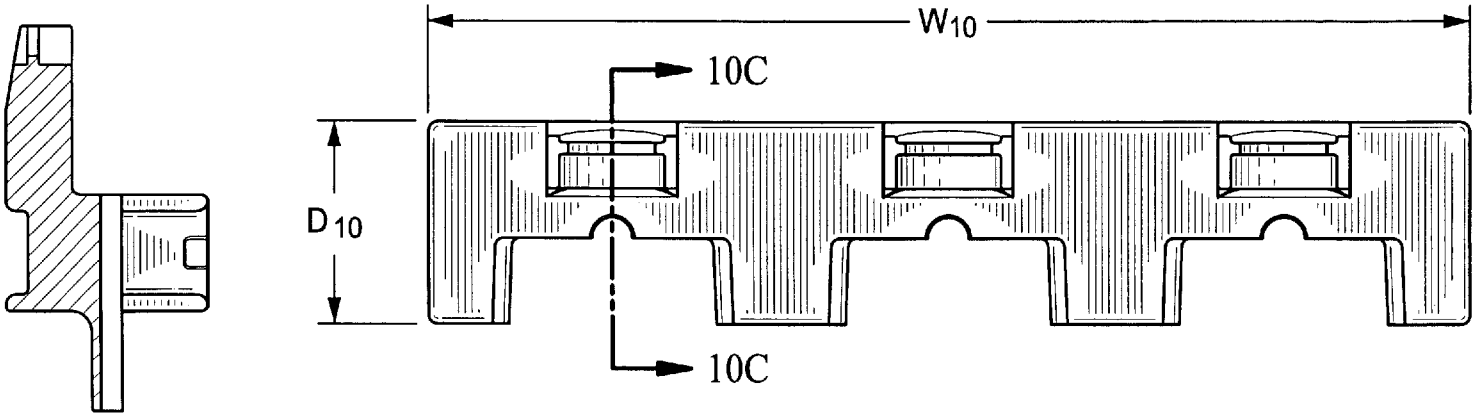
FIG. 10B
FIG. 10C
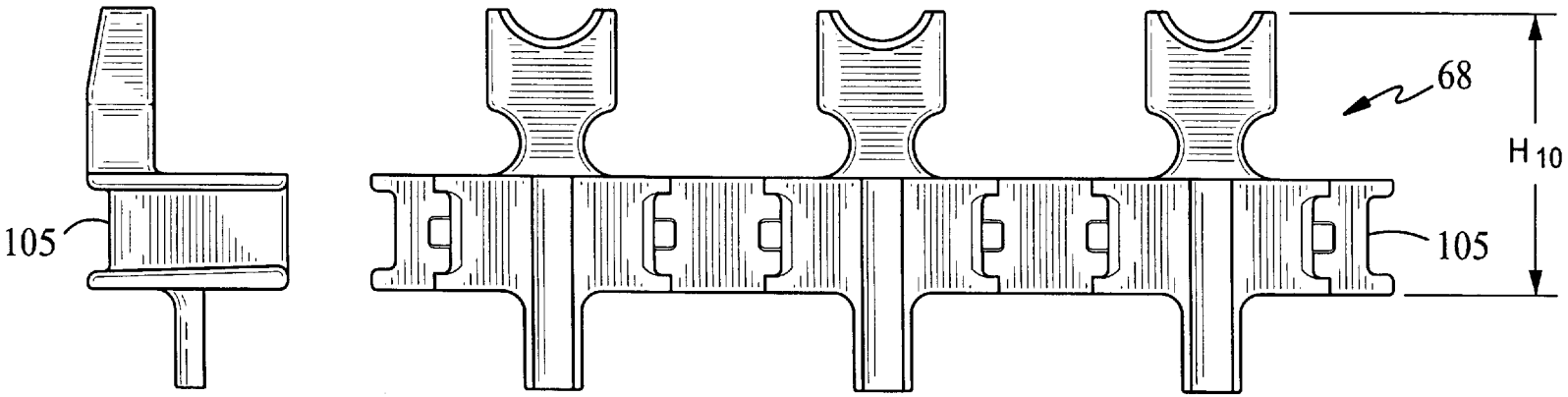
FIG. 10A

BEVERAGE DISPENSER

TECHNICAL FIELD

This invention relates to beverage dispensers.

BACKGROUND

Beverage dispensers are used in a variety of environments, including restaurants, cafeterias, convenience stores, and the like. A dispenser holds a supply of beverage product, usually in a refrigerated compartment. The dispenser includes a dispensing mechanism, typically involving valves that can be controlled by an actuator, such as a lever assembly, which can be operated to dispense the beverage.

One common sort of dispenser stores a concentrate of the beverage and then mixes it with water just before or after dispensing. In another type of dispenser, the beverage itself is stored and is directly dispensed without any mixing. The latter type is considerably more simple in terms of the plumbing needed but may require more frequent resupply of beverage product.

The beverage product may be stored in a bag-in-box container. In this arrangement, the beverage product is provided in flexible plastic bag which collapses as the liquid is withdrawn, thus eliminating the need for a vent. The bag is disposed in a box, typically made of cardboard, for ease of handling. A dispenser for direct dispensing of a beverage from a bag-in-box container is described by Erb U.S. Pat. No. 5,938,077.

SUMMARY

In an aspect, the invention features a beverage dispenser including a cabinet with a shelf assembly for support of a bulk beverage container. The container includes a mechanically operable gravity-fed piston valve that can be controllably opened and closed to dispense beverage from the container in a generally downward direction. A valve actuator is supported on the shelf assembly below the valve and is coupled to the valve. A beverage pathway lumen extends from the valve below the shelf assembly to direct beverage from the valve to a receptacle during dispensing.

In some embodiments, the beverage pathway lumen is defined by a tube, and the tube is removably attachable to the valve. The actuator may have a pivoting element extending below the valve. The pivoting element includes an upper member engaging the valve and a lower member which can be moved to actuate the valve. The actuating member may include a linearly translated push element which is translated upwardly to open the valve and is coupled to a pivoting member. The lower member may be adapted to receive the beverage receptacle; the pivoting element can be a lever-form or a living hinge. The lower member of the pivoting member can be a lift handle.

The actuator of the dispenser can include a body attached to the shelf assembly and to which the pivoting element is articulated, and the beverage pathway can extend through the body. The tube can extend through an opening in the body and can include a retaining region having a cross-section larger than the opening. The tube is preferably about 4 to about 6 inches long. The body preferably includes two pieces about the beverage pathway lumen. The tube can include vent openings; the vent openings may be in the retaining region; the vent openings may also be upwardly oriented.

In other embodiments, the shelf assembly is adapted to receive a bag-in-box container. Preferably, the shelf assembly includes a cabinet with a door disposed opposite the valve. The shelf assembly may also include a support stand, outside a refrigerated space.

In another aspect, the invention features a beverage dispenser including a cabinet for receiving a bag-in-box container and a shelf assembly at the bottom of the container for supporting the container. The container includes a gravity-fed piston valve that can be controllably opened and closed to dispense beverage from the container in a generally downward direction. A valve actuator is coupled to the valve and includes a valve body attached to the cabinet below the valve. A beverage pathway lumen extends through the valve body to direct beverage from the valve to a receptacle during dispensing.

In some embodiments, the beverage pathway is defined by a tube removably attached to the valve. The tube may extend through an opening in the body and may include a retaining region having a cross-section larger than the opening. The tube is preferably about 4 to about 6 inches long. The body preferably includes two pieces about the beverage pathway lumen. Preferably, the tube includes vent openings; the vent openings may be in the retaining region and may be upwardly oriented.

In some embodiments, the actuator has a pivoting element extending below the valve, and the pivoting member includes an upper member engaging the valve and a lower member which can be moved to actuate the valve. The lower member may be adapted to receive the beverage receptacle. The pivoting element may be a lever-form. In other embodiments, the actuating member includes a linearly translated push member which is translated upwardly to open the valve and is coupled to the pivoting member. The pivoting member may be a living hinge, and the lower member may be a lift handle.

In other embodiments, the shelf assembly includes a cabinet with a door. The shelf assembly preferably includes a support stand housing a refrigeration unit.

In another aspect, the invention features a beverage dispenser including a beverage cabinet including a shelf assembly for support of a bulk beverage container. The container includes a mechanically operable, gravity-fed piston valve that can be controllably opened and closed to dispense beverage in a generally downward direction and a valve actuator supported on the shelf assembly and coupled to the valve.

In some embodiments, the dispenser includes an access door defining a cabinet wall opposite the valve. In other embodiments, the actuator has a pivoting element extending below the valve, and the pivoting element includes an upper member engaging the valve and a lower member, such as a lift handle, which can be moved to actuate the valve. Preferably, the lower member is adapted to receive the beverage receptacle. The pivoting element may be a lever-form or a living hinge. The actuating member may include a linearly translated push element which is translated upwardly to open the valve and is coupled to the pivoting member. In other embodiments, the actuator may include a body attached to the shelf and to which the pivoting element is articulated, and a beverage pathway tube may extend through the body.

Embodiments may include one or more of the following advantages. The dispenser is convenient, easy to use, and easy to maintain. It can make practical direct dispensing of beverage without any pre or post-mixing in high use environments such as restaurants, cafeterias, conference rooms, etc. The beverage pathway lumen provides a directed flow of beverage that can essentially eliminate splashing into the dispensing body or cabinet, thus reducing clean-up effort and the possibility of unsanitary conditions in the dispenser. The venting of the flow path prevents trapping a slug of beverage in the flow path after the beverage that can essentially eliminate splashing into the dispensing body or cabinet, thus reducing clean-up effort and the possibility of unsanitary conditions in the dispenser. The venting of the flow path prevents trapping a slug of beverage in the flow path after the dispenser actuator is operated to dispense. This assures that the beverage is fresh each time the actuator is operated. The actuator body can be removeably assembled just below the container to assure accurate and easy alignment of the actuator with the valve arrangement and avoid misalignment caused by opening and closing the door during replacement of the beverage container. The actuator body can be a two piece member arranged around the beverage pathway for easy assembly, disassembly and cleaning. The pathway can be defined by a removable flow tube extending from the valve through the body and the vent openings define enlarged retaining regions that have a cross section larger than the lumen through the body so that the tube cannot accidentally fall through the body into a user receptacle.

Still further aspects, features and advantages follow.

DETAILED DESCRIPTION

We first briefly described the drawings.

DRAWINGS

FIGS. 8A–8F are views of a pivot member, while

FIGS. 10A–10C are views of the back piece actuator assembly in FIG. 6

DESCRIPTION

Figure 1:
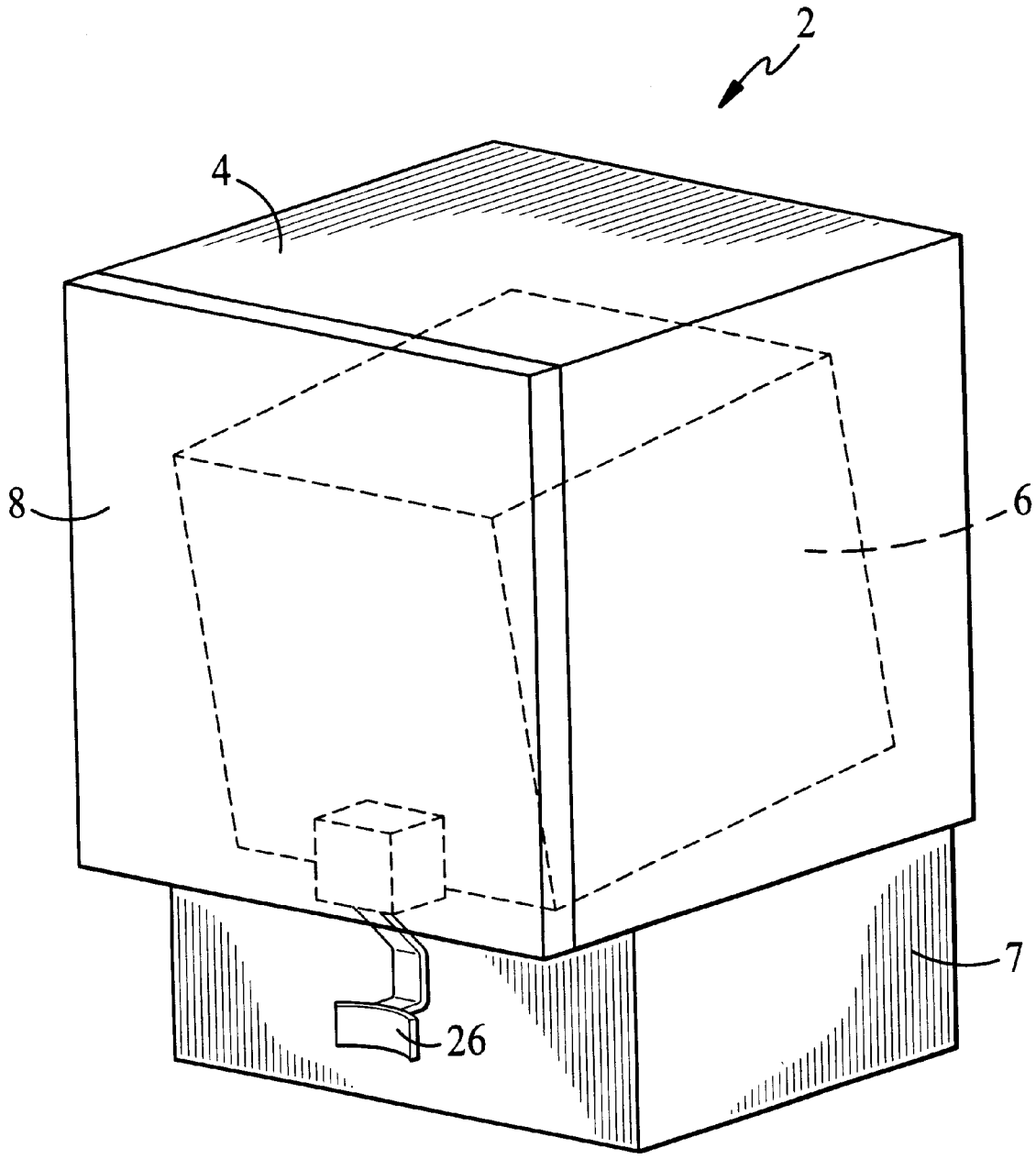
FIG. 1 is a perspective view of a dispenser.
Figure 2:
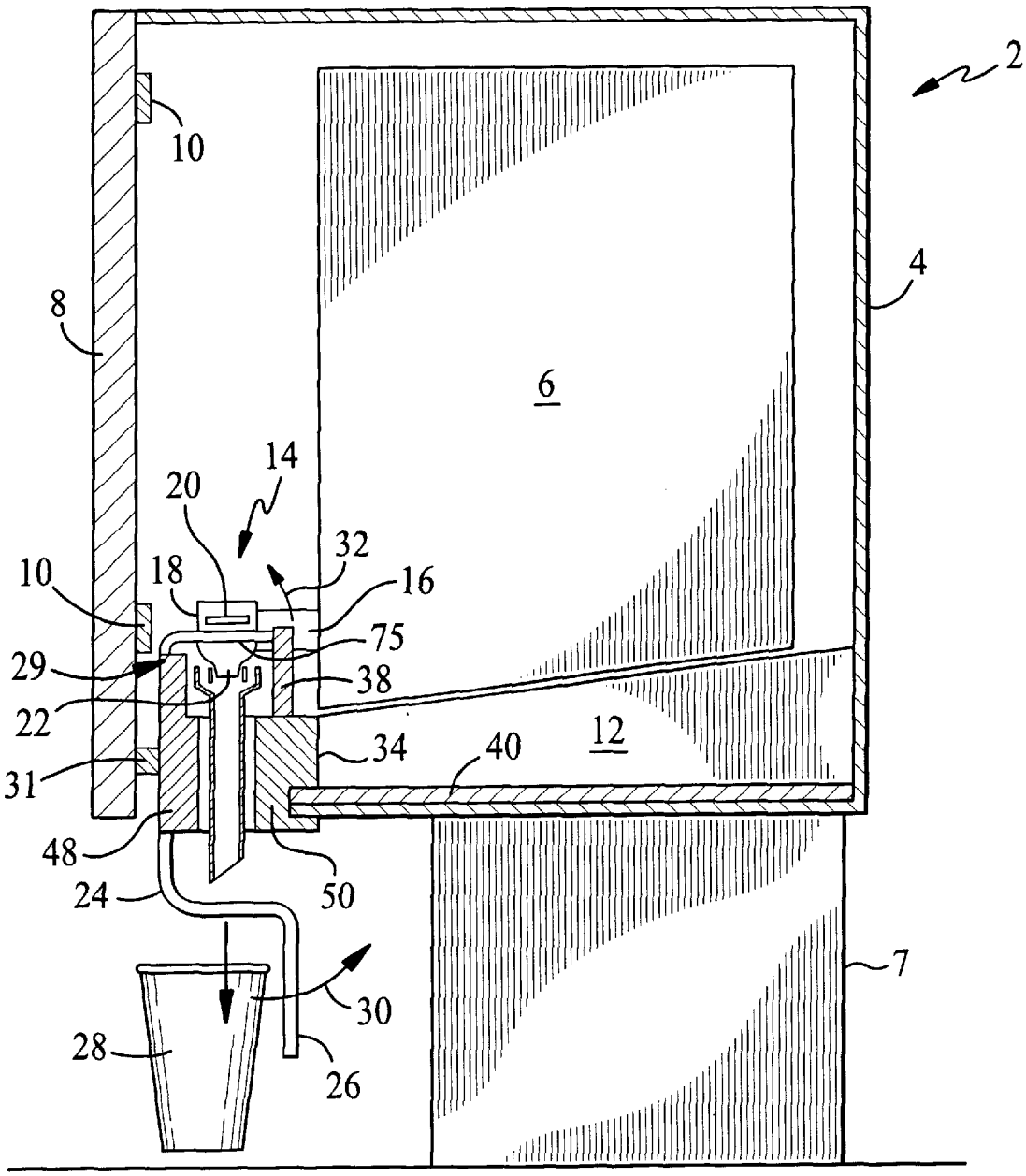
FIG. 2 is a cross sectional side view of the dispenser in FIG. 1.
Figure 3:
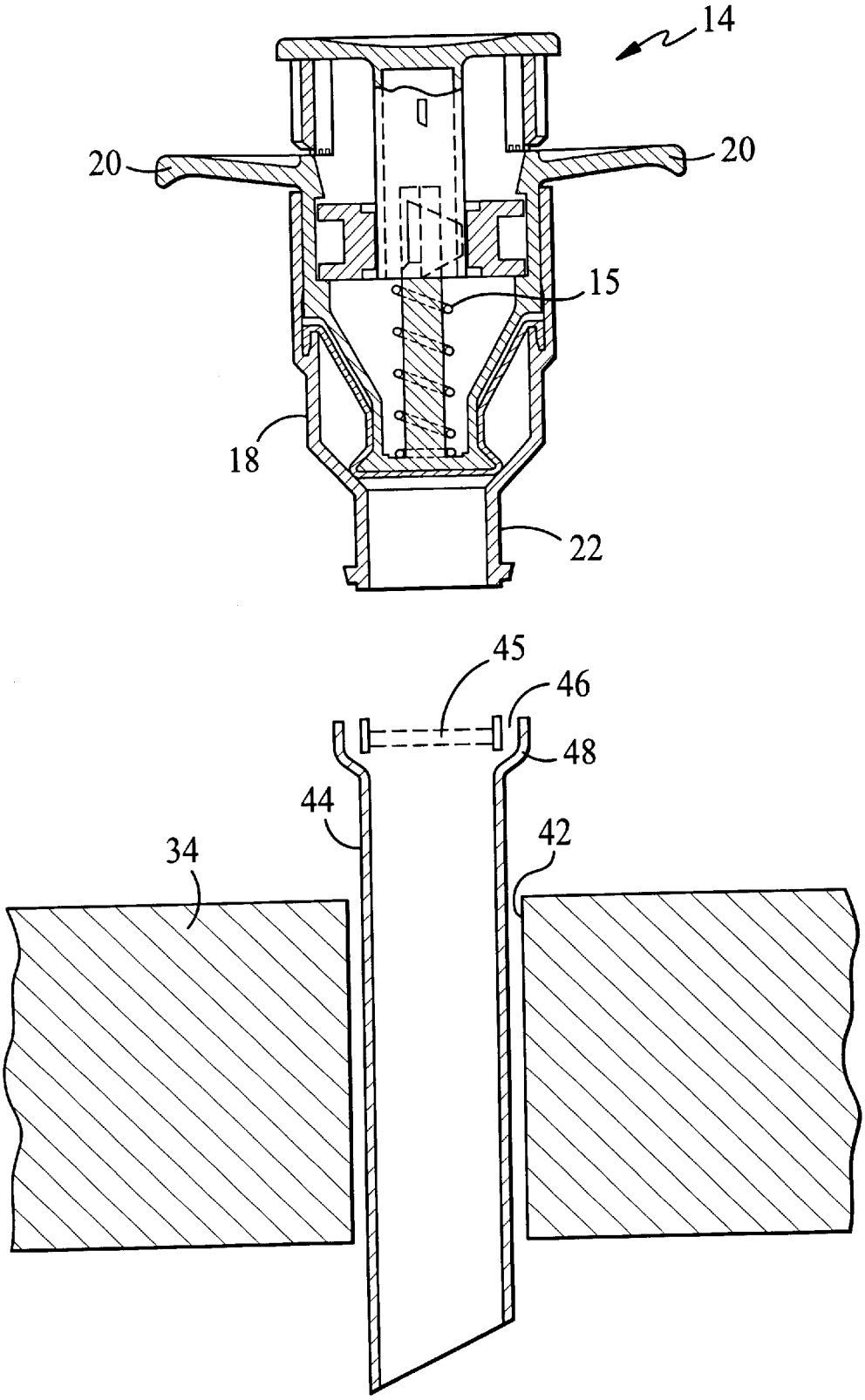
FIG. 3 is an enlarged, exploded view of a portion of the dispenser in FIG. 2, illustrating the valve and beverage flow path.

Referring to FIGS. 1 and 2, a dispenser 2 includes a cabinet 4 enclosing a bag-in-box container 6. The cabinet is supported on a base 7, which may house a refrigeration unit, and has a front door 8 which can be opened on hinges 10 to replace the container 6. Referring particularly to FIG. 2, the container 6 is supported on a shelf 12 which has a top surface that is angled downwardly to encourage fluid toward a valve 14. The valve 14 is attached to the bag through a collar 16. Referring to FIG. 3, the valve 14 is a piston-type valve. A piston 15 can be lifted to open the valve by upward motion on flanges 20 which extend through the valve body 18. Fluid flows in a generally downward direction through a spout section 22 of the valve. A suitable valve is described in EP 432 070, the entire contents of which is incorporated by reference, and is available from The Vitop Company, Schalbach, France.

The valve is operated by a pivot actuator assembly. The actuator assembly includes a pivot member 24 that has an upper portion 25 for engaging the flanges 20 of the valve 14 and a lower portion 26 adapted to receive a receptacle such as a glass 28. As a user presses the glass against the lower portion, the pivot member rotates (arrows 30, 32) about a pivot location 29 such that the upper portion 25 lifts the flanges 20 thus opening the valve.

The pivot member 24 is articulated to an actuator body 34 which defines pivot location 29 laterally forward of the valve and positions the actuator spatially with respect to the valve. A stirrup 38 extends upwardly from the body 34 to cradle the collar 16 of the bag and to laterally and vertically position the body 18 of the valve relative to the pivot member 24. The actuator body 34 is attached to the cabinet on a subshelf 40 of the cabinet shelf 12. A sealing gasket 31 on the interior of the door 38 seals against the body when the door is closed. As a result, the actuator and the valve are not disturbed when the door 8 of the cabinet is opened.

The shape of the pivot member and the location of the pivot provide a compact pivoting motion that does not interfere with the cabinet door. The upper portion 25 of the pivot member extends generally inwardly toward the valve from the pivot location. As a result the radial motion of the pivot member does not cause significant extension of the pivot member outwardly where it could interfere with the door.

The actuator body 34 includes a lumen 42 through which beverage can pass. The lumen 42 is occupied in this embodiment by a flow tube 44 which defines a beverage flow path from the valve through the actuator body 34. The flow tube 44 prevents fluid splashing into the cabinet and onto the actuator components as beverage emerges from the valve, a problem that can occur with when the fluid is expelled at high pressure, particularly in a gravity fed valve arrangement. The tube 44 has a length and diameter sufficient to direct the fluid into a more uniform path toward the receptacle. Preferably, the lumen extends below the cabinet shelf to guide fluid out of the cabinet. The tube can be made of polymer which absorbs the lateral energy of the spray as it emerges from the valve.

The tube 44 may be removeably attachable to the spout section 22 of the valve by pressfitting. In this way the tube can be easily replaced or cleaned, for example, when a beverage container is being replaced. The spout section may include adapter nubs which can aid retaining the tube 44. The tube 44 includes a recess 45 into which the nubs are disposed. In addition, the tube 44 includes a series of vent openings 46 which prevent a slug of beverage from being retained in the tube after the valve has been closed. The vent openings 46 are provided in a series retaining wings 48 which extend radially from the tube. The retaining wings 48 define a diameter that is greater than the diameter of the lumen 42 through the device body 34, thus preventing the tube from slipping through the body into the receptacle 28 should the tube become dislodged from the valve.

As illustrated in FIG. 2, the actuator body 34 is preferably a two piece member, having a forward piece 48 and a rearward piece 50, arranged about the lumen to facilitate loading and cleaning. The two pieces can be found with interfitting mating structure to allow the pieces to be slid together or apart without the use of tools, clamps, or fasteners.

In use, the operator opens the door 8 of the cabinet to remove and replace a container 6. The forward piece 50 of the body is removed, carrying the pivot member 24. The flow tube 44 is slipped from the spout section of the valve and discarded or washed. The empty container can then be removed from the cabinet. A new container is placed in the cabinet by aligning its collar 18 with the stirrup 38. The flow tube 44 is press fit onto the spout portion of the valve and the front piece 50 of the body 34 carrying the pivot member 24 is reassembled to the back piece 48. The door is closed and the dispenser is ready for use.

Figure 4:
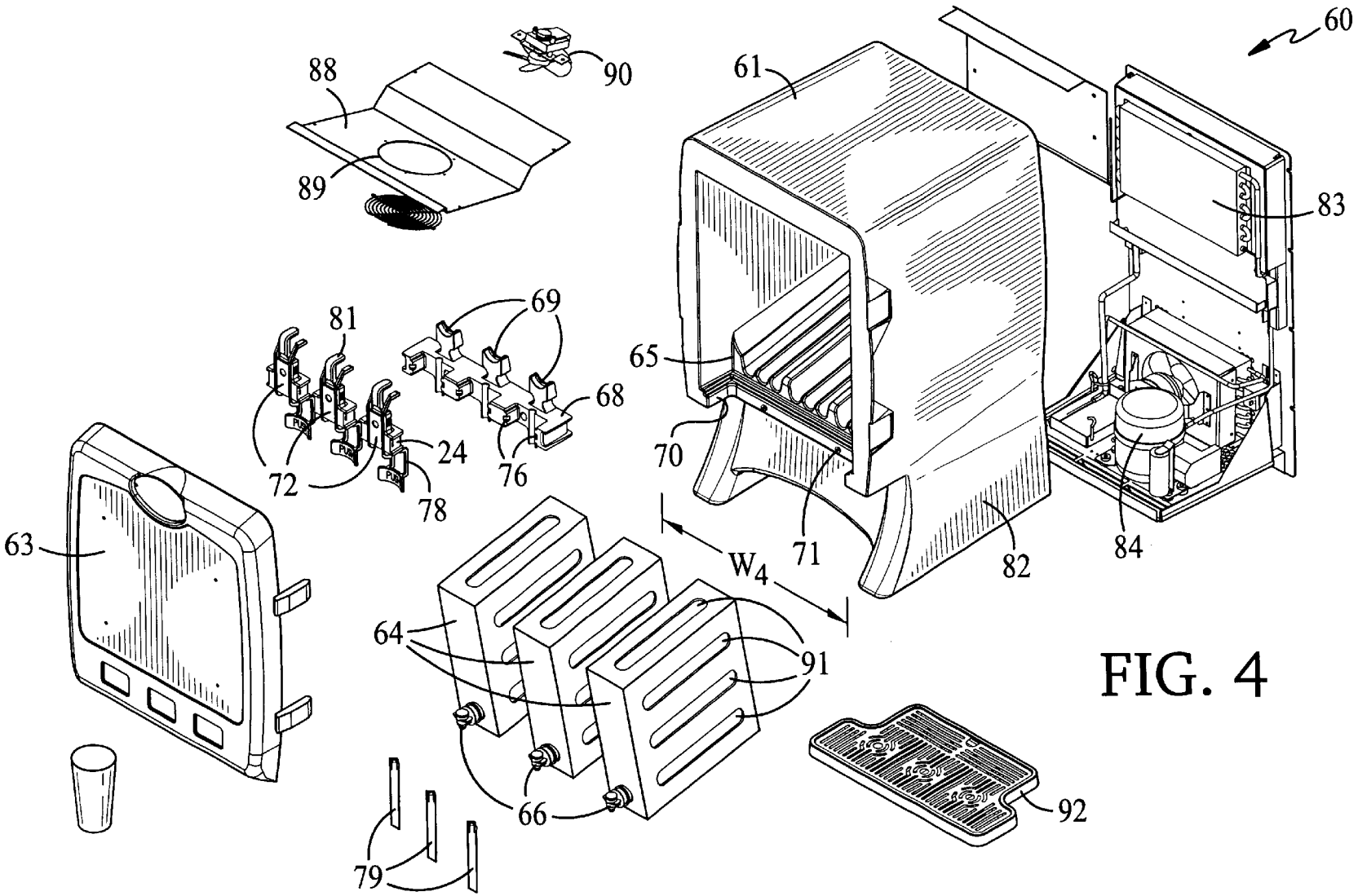
FIG. 4 is an exploded view of an embodiment of a dispenser.
Figure 5:
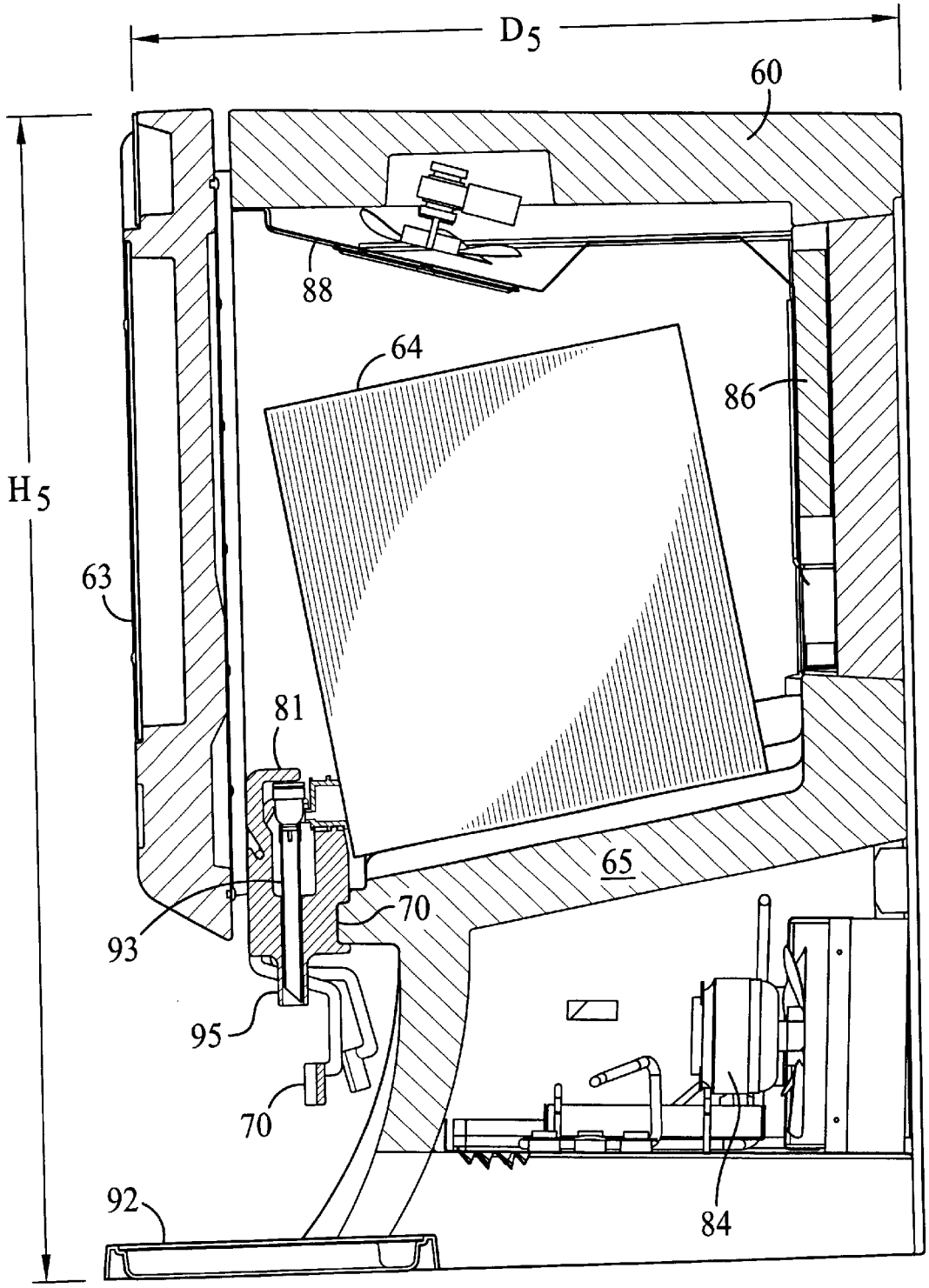
FIG. 5 is a cross-sectional side view of the dispenser in FIG. 4.
Figure 6:
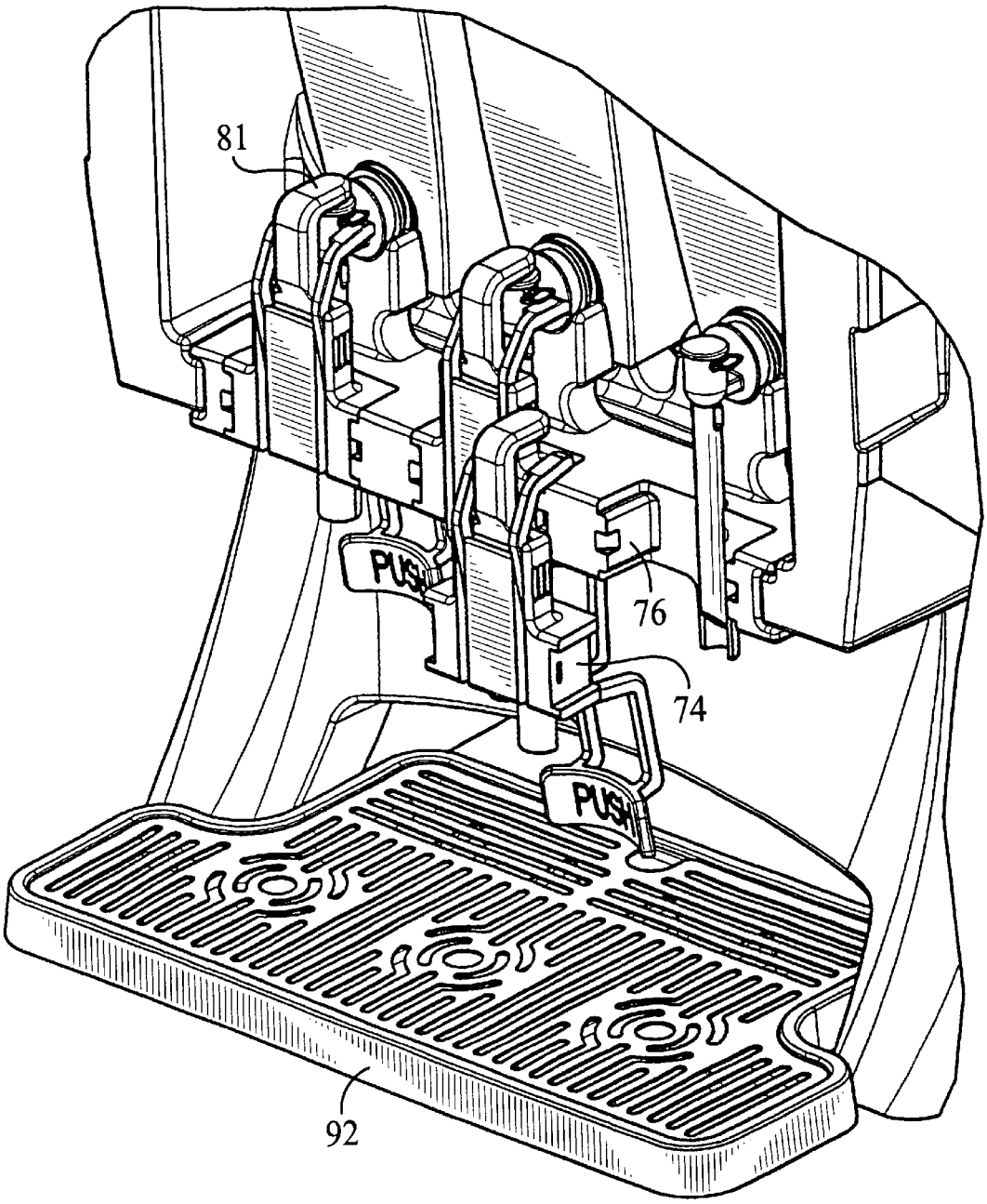
FIG. 6 is an enlarged perspective view of the valve and valve actuator assembly of the dispenser of FIG. 4.

Referring to FIGS. 4–6, in a particular embodiment, a dispenser 60 has a cabinet 61 with a side-hinged front-loading door 63 that encloses three containers 64, each carrying a piston valve 66, and are supported on a bottom shelf 65 of the cabinet. The actuator includes a body with unitary back piece 68 that is slideably supported on a sub-shelf 70 and secured by removable, threaded stud inserts 71. Alternatively, a bracket arrangement including a locking pin member which extends from the shelf and mates with an opening in the body 68. The pin and body can be eccentrically shaped to cause locking of the body 68 as it is pressed on the pin. The back piece 68 includes three stirrups 69 to cradle the collars of the containers. Three front pieces 72 are slideably fit with the back piece 68 by a series of interfitting mating surfaces 74, 76 (FIG. 7). Each front piece includes a pivot member 78. The front piece also carries a tongue 81 which fits over the top of the valve to prevent upward motion when the actuator is pivoted to dispense. A flow tube 79 is provided for each valve. The dispenser has a base 82 that houses a refrigeration unit 84. The refrigeration unit has a baffle system 86, 88, forming a duct work through which cooling air is drawn from the base over a refrigeration evaporator 83 to the cabinet compartment by a fan 90 which then directs the cool air into the compartment. The baffle plate 88 includes a lip 89 which extends upward by about 0.5 inch to enhance air flow. The box surrounding the beverage bag is preferably provided with openings 91 in side walls, top and bottom (not shown) to facilitate circulation. A drip pan 92 is provided below the actuator.

The cabinet may be a molded plastic body with an internal volume of about 2.5 cubic feet which accommodates three two gal bag in box containers. The dispenser has an overall height, $H_5$, of 36 inch an overall width, $W_4$, of 22 inch and an overall depth, $D_5$, of 24 inch.

Figure 7B:
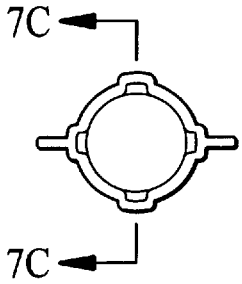
FIGS. 7A and 7B are side and top views, respectively, of a dispenser tube.
Figure 7A:
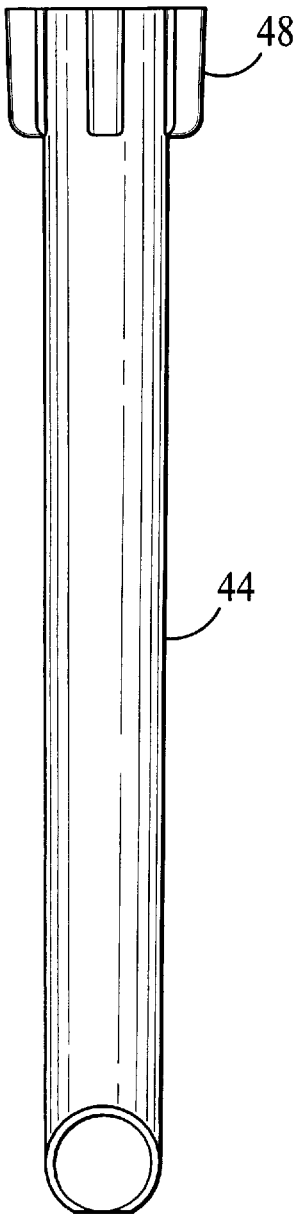
Figure 7C:
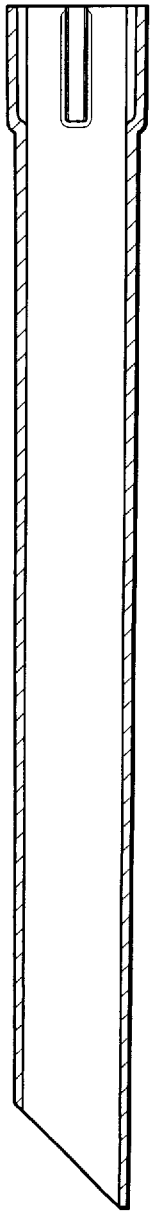

Referring particularly to FIGS. 7A and 7B, the flow tube is made of a somewhat resilient polymer such as polyethylene and has an outer diameter, $d_7$, of about 0.51 inch and an inner diameter of 0.42 inch. The inner diameter of the tube is slightly smaller than the spout portion of the valve. A preferred valve is available from The Vitop Company, Schelbach, France, which has a spout outer diameter of about 0.47 inch. The retaining regions 91 have an outer diameter of about 0.85 inch and include vent openings of about 0.02 inch. The outlet end of the tube is beveled at a 45° angle. The lumen 93 through the valve body has an inner diameter $d_7$ of about 0.63 inch. The tube has a length $L_7$ of about 5.5 inch. As illustrated in FIG. 5, the tube extends from the spout portion of the valve into the valve body. The lower portion of the beverage passageway extends beyond the tube and is defined by a tubular extension 95 of the valve body, which extends from the body about 1.5 inches.

Figure 8E:
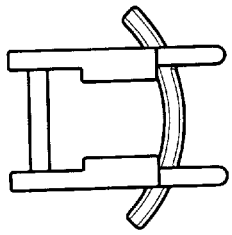
Figure 8A:
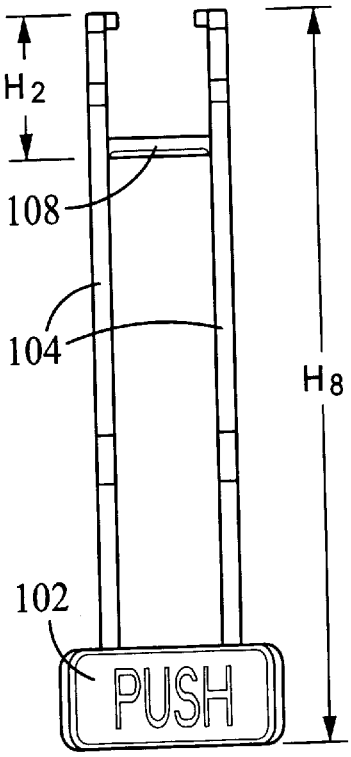
Figure 8B:
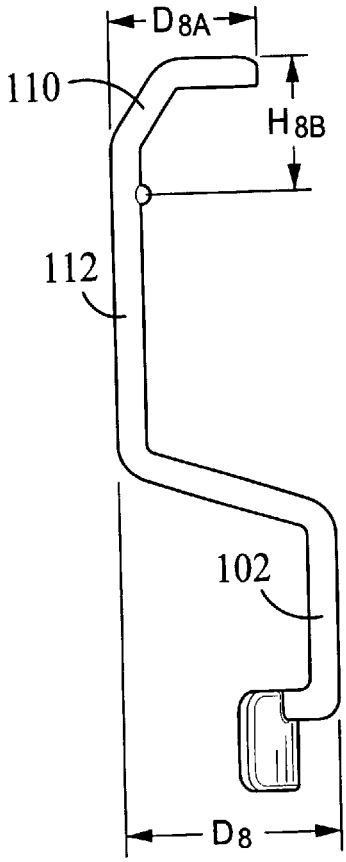
Figure 8D:
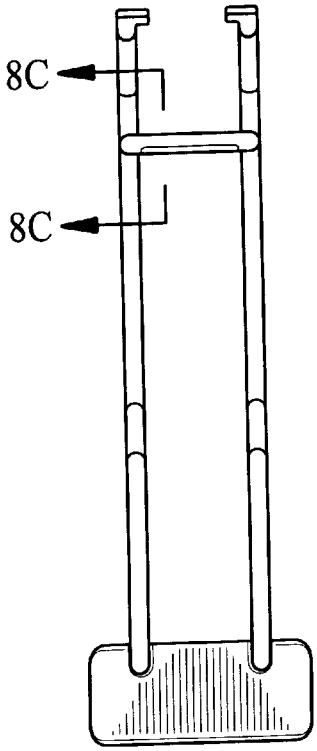

Referring to FIGS. 8A to 8B, the pivot member includes a cup receptacle piece 102 from which extend a pair side bars 104 to the engaging portion 106. A pivot bar 108 extends between the side bars. The pivot member is configured so that it does not protrude from the actuator body 34 and interfere with the cabinet door during pivoting. The pivot location is positioned just below the angle member 110, which is directed inwardly at about 33.5° toward the cabinet and thus does not engage the door during dispensing. A down section 112 at the pivot member resides in grooves on the face of the device body.

In addition, the pivot location is chosen so that the pivot bar can operate the valve with a low force that will not damage a receptacle such as a conventional plastic cup. For example, for a piston valve having an opening force of about 5 lbs., the actuator provides a mechanical advantage of about 0.16 to 1 that permits an operation force of about 0.8 lbs. The pivot element has an overall height, $H_8$, of about 9.2 inch, with the pivot bar located at a distance $H_{8B}$, about 1.68 inch below the top of the engaging portion. The lower portion has a depth, $D_8$, of about 2.71 inch and the upper portion has a depth $D_{8A}$ of about 1.85 inch. The pivot member is formed of metal such as stainless steel or aluminum or a plastic. The side bars have a diameter of about 0.23 inches. The mechanical advantage of the dispenser assembly is about 0.16 to 1, such that a valve with an opening force requirement of 4 lbs can be opened with the assembly with 0.64 lbs. The balance movement, the calculation for which is illustrated in FIG. 8G, is about 0.16. The pivot location is positioned so that the pivot bar rotates slightly to its rest location by gravity, rather than the closing force of the valve.

Figure 8C:
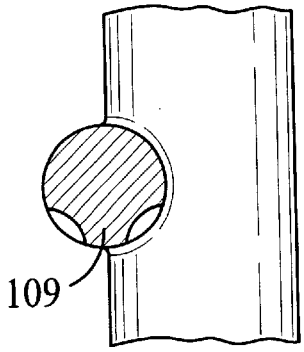
Figure 8F:
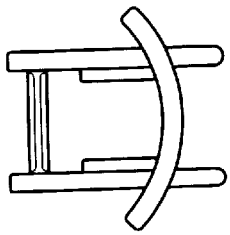
Figure 8G:
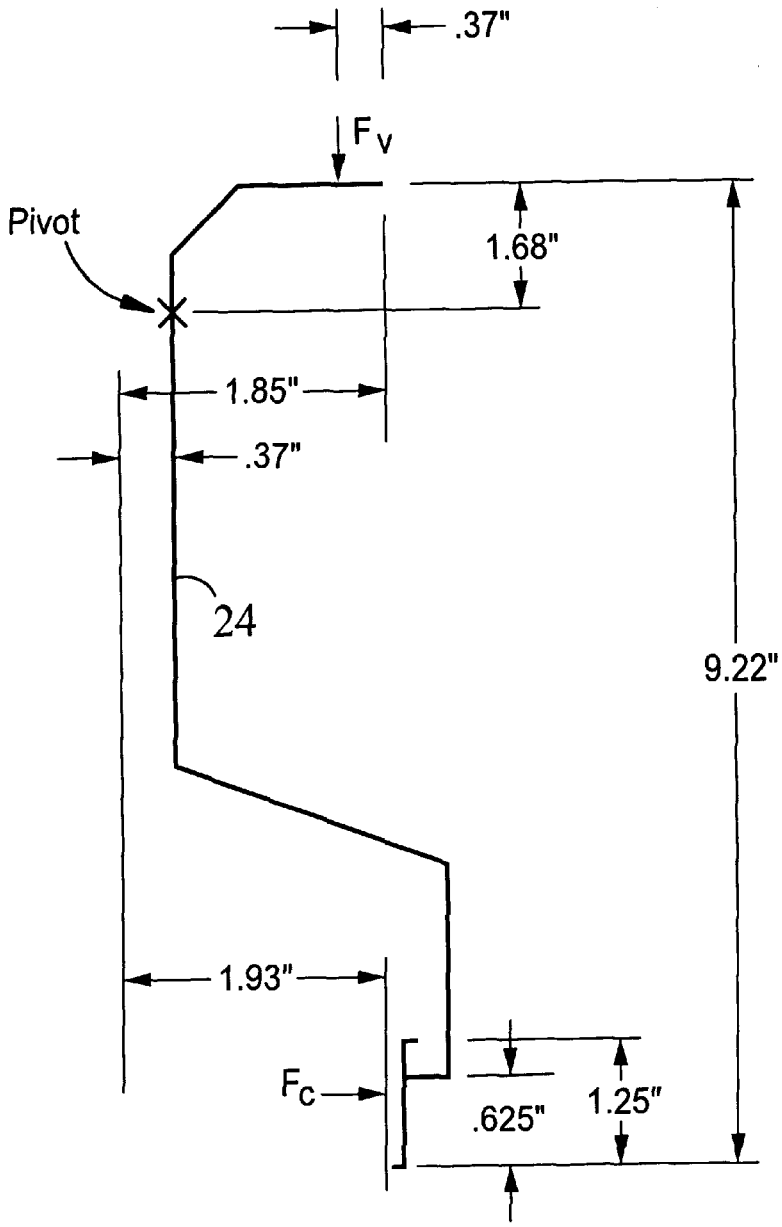
FIG. 8G illustrates calculation of balance moments around the pivot.

Referring to FIG. 8C, the pivot bar 108, which rests in a pivot well in the actuator body, has a cross section that defines a low surface area pivot region 109. The low surface area pivot region reduces hang-ups and sticking should beverage become spilled in the pivot well. The pivot bar has a diameter of about 0.24 inch. The pivot region if formed by cut-outs of radius 0.078 inch and a maximum recess depth of 0.032 inch. The pivot region does not slide within the well, but rather rotates as it is actuated.

Figure 9E:
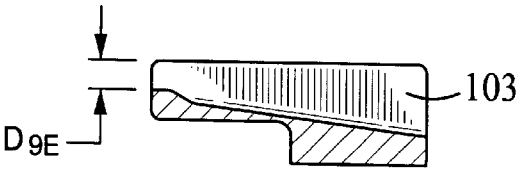
FIGS. 9A–9F are views of the front piece of the actuator assembly in FIG. 6.
Figure 9F:
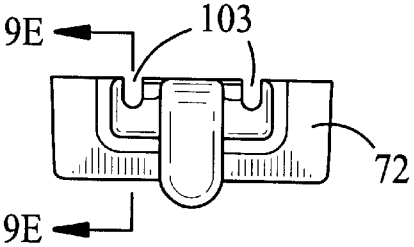
Figure 9D:
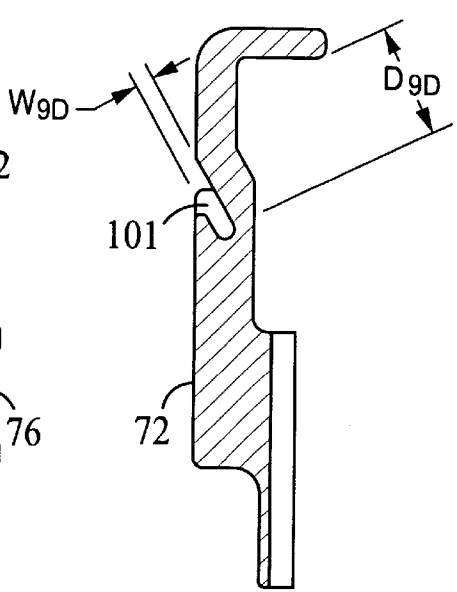
Figure 9C:
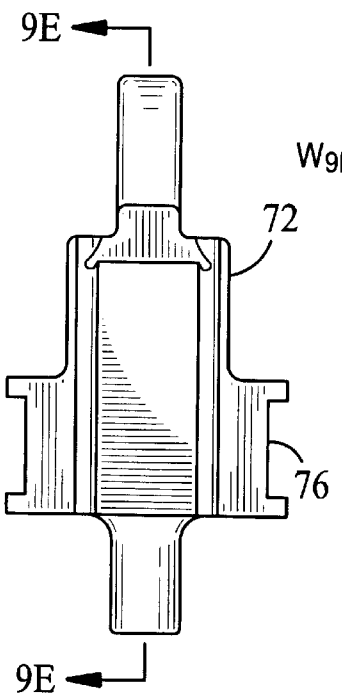
Figure 9B:
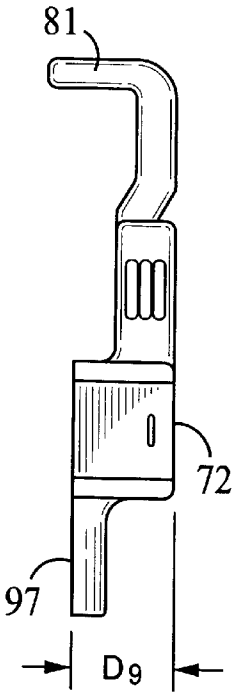
Figure 9A:
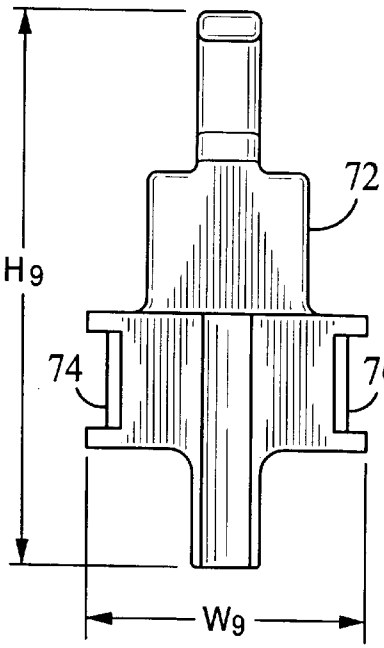

Referring to FIGS. 9A–9F, the front piece 72 of the body is configured with mating surfaces 74 for sliding assembly with the back piece 68. A tongue portion 81 resists upward motion of the valve during dispensing, and a bottom portion 97 that defines, an extension of the beverage flow path. Referring particularly to FIG. 9B, the pivot bar well is configured as a slot 101 angled downward and inward on the body to discourage dislodging of the pivot member. The slot has a width $W_{9D}$ of about 0.25 inch, a depth $D_{9D}$ of about 0.5 inch and a radius of about 0.125 inch. Referring particularly to FIGS. 9E and 9F, the body also includes a pair of slots 103 into which the sidebars 104 of the pivot member are recessed. The slots have increasing depth toward the bottom of the body to accommodate the inward pivoting motion of the portion of the member below the pivot point. The minimum depth $D_{9E}$ of the top of the slots is about 0.365 inch and the maximum depth $D_{9E1}$ of the bottom is about 0.919 inch. A small knob just below the top facilitates pivot motion. The front portion has an overall height, $H_9$ of 7.1 inch, an overall width, $W_9$ of 3.49 inch, and an overall depth $D_9$ of 1.29 inch.

Referring to FIGS. 10A–10C, the back piece 68 of the body includes mating surfaces 105 configured for sliding engagement with subshelf 70 on the cabinet. The back piece 68 has an overall height $H_{10}$ of 5.8 inch and an overall width $W_{10}$ of 15.6 inch and an overall depth $D_{10}$ of 3 inch. An extension member defines, with the bottom portion of the front member, and extends the beverage pathway. The extension has a length $L_{10}$ of about 1.5 inches.

Figure 11:
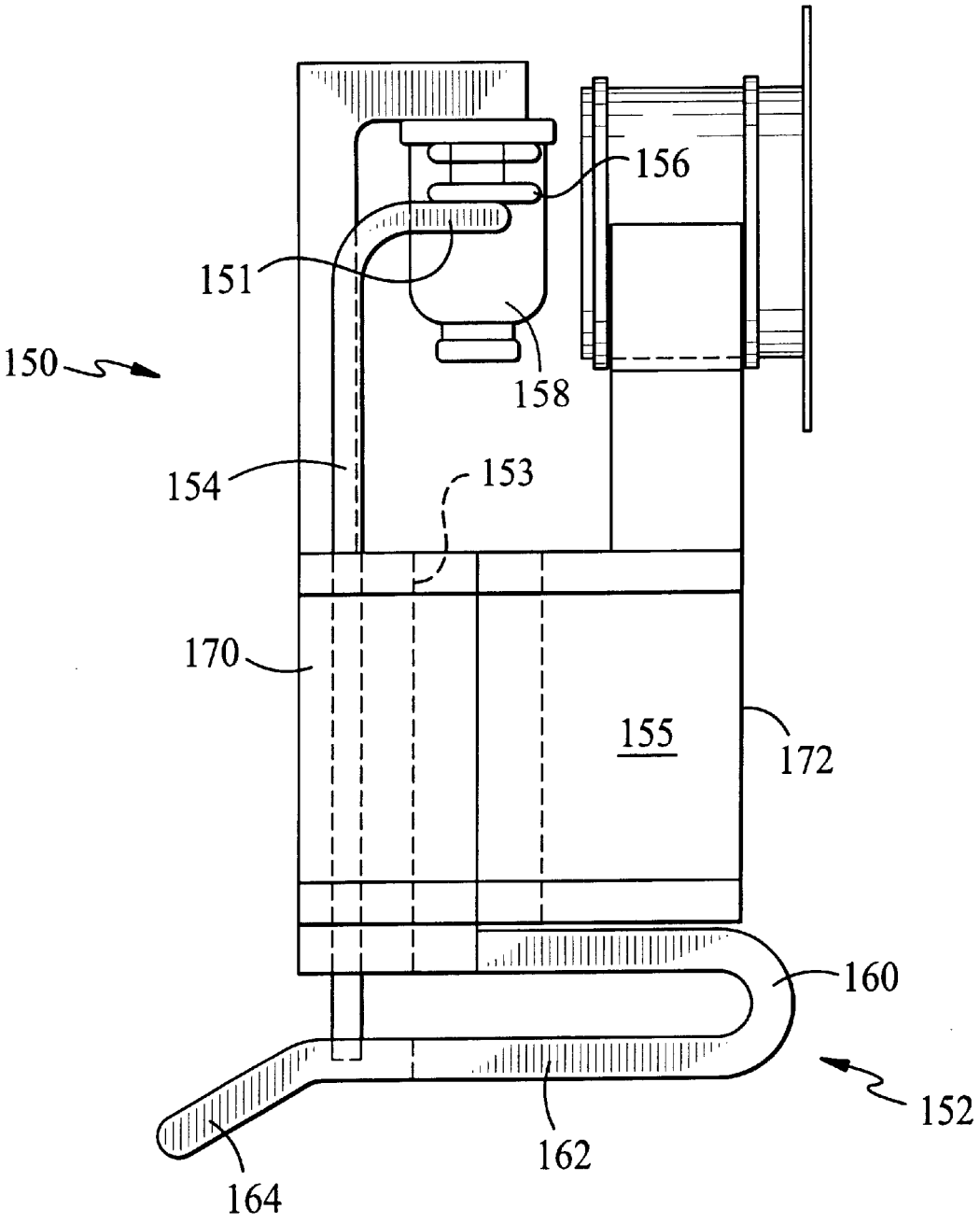
FIG. 11 is a side view of an actuator assembly.
Figure 12B:
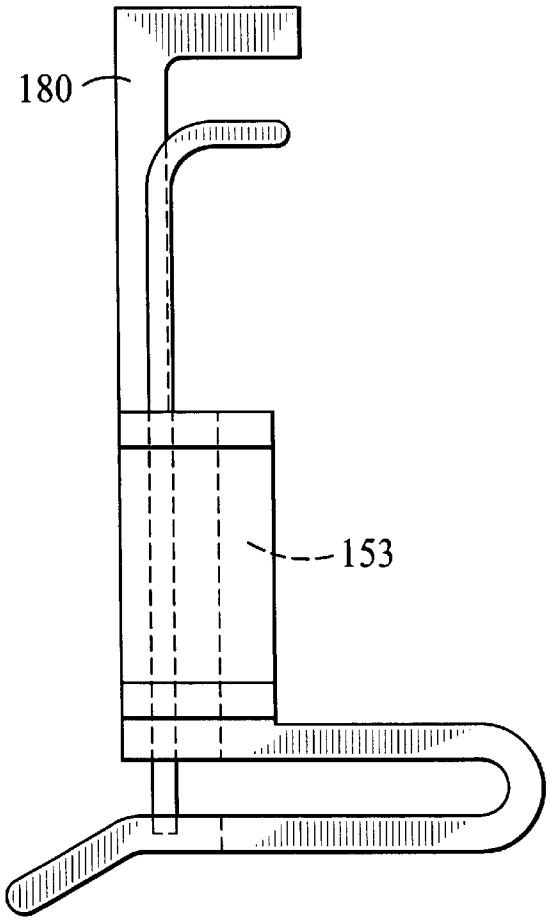
FIGS. 12A and 12B are side or front views, respectively, of the front piece of the assembly in FIG. 11.
Figure 12A:
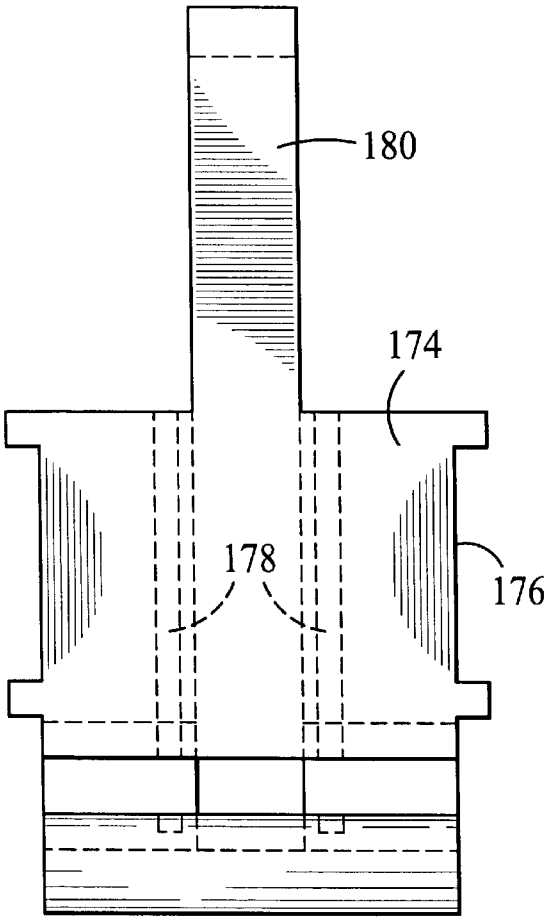
Figure 13B:
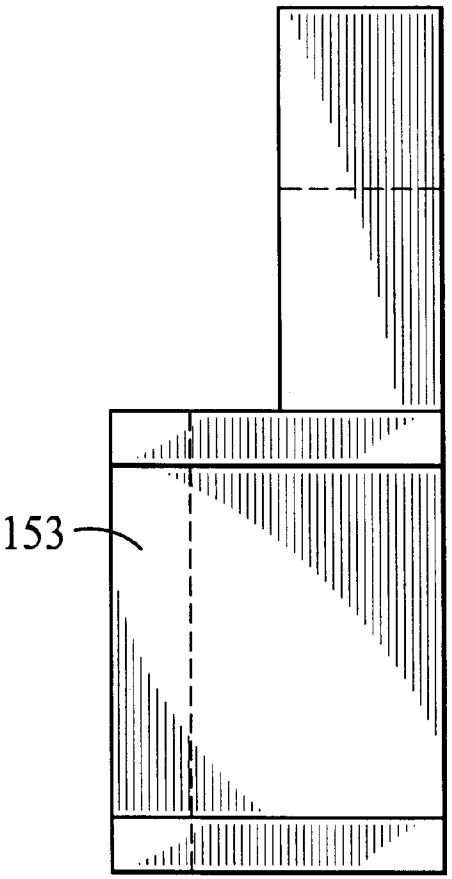
FIGS. 13A and 13B are front and side views, of the back piece of the assembly in FIG. 11.
Figure 13A:
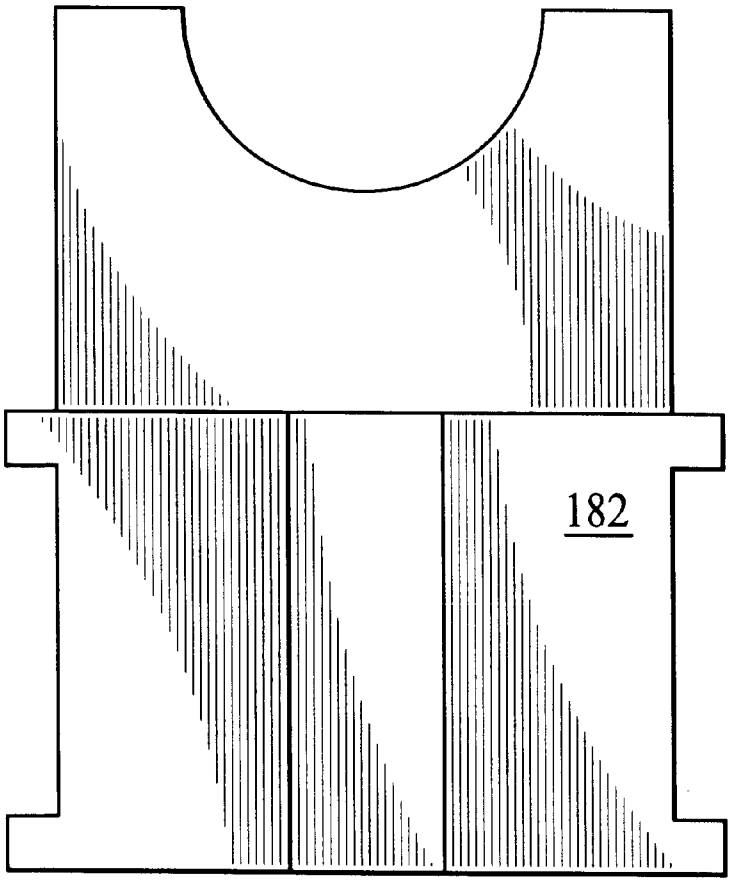

Referring to FIG. 11, an alternate actuator assembly 150 utilizes a pivot member 152 to translate lift rods 154 that engage the flanges 156 on a valve 158. A beverage flow passage 153 passes through an actuator body 155. The pivot member 152 has a living hinge 160, a rod control piece 162 and a lift handle 164. In operation, the user places a receptacle beneath the beverage passage 153 and lifts upward on the lift handle 164. The piece 162 translates the rods 154 upwardly such that engagement portions 151 push the flanges 156 on the valve upward, opening the valve. A flow tube (not shown) can be provided to direct fluid toward the receptacle. The living hinge 160 is formed of a resilient polymer such as HDPE polypropylene or Delrin (Dupont, Del.). It may also be metal.

Referring as well to FIGS. 12A–13B, the body 155 has a front piece 170 and a back piece 172 arranged in a clam-shell fashion about the lumen 153. The front piece induces a mid-portion 174 with mating surfaces 176 to permit slideable assembly with the back piece. The front piece also includes passageways 178 in which the push rods may be slideably disposed. A tongue 180 extends upwardly such that is resides above the valve to oppose upward motion.

The back piece 172 has a portion 182 with mating surface 184 for slideable assembly with the front portion. The back piece 172 also carries a yoke 186 into which the collar of the valve may be disposed. The back piece may be attached or integral with the shelf on the cabinet. The compact lateral actuation allows valve operation without interfering with the cabinet door.

In other embodiments, the valve body may include a back portion that is integrally formed with the dispenser. The valve body may be a one piece member. The flow path may be defined by the valve body. The valve body may include a cut out around the flow tube, rather than a lumen.

Still further embodiments are within the claims.

What is claimed is:

1. A beverage dispenser comprising a beverage cabinet including a shelf assembly adapted to support a bulk beverage container having a bottom and a first side, a mechanically operable, gravity-fed piston valve adapted to engage with the first side of the container, wherein the valve can be controllably opened and closed to dispense beverage from the container in a generally downward direction, a valve actuator supported on the shelf assembly below the valve and coupled to the valve, and a beverage pathway lumen extending from the valve below the shelf assembly to direct beverage from the valve to a receptacle during dispensing, wherein the actuator has a pivoting element extending below the valve, the pivoting element including an upper member engaging the valve and a lower member which can be moved to actuate the valve, and the actuator includes a body attached to the shelf assembly and to which the pivoting element is articulated, the beverage pathway extending through said body.

2. The dispenser of claim 1 wherein the beverage pathway lumen is defined by a tube.

3. The dispenser of claim 2 wherein the tube is remove ably attachable to the valve.

4. The dispenser of claim 1 wherein the lower member is adapted to receive the beverage receptacle.

5. The dispenser of claim 4 wherein the pivoting element is a lever-form.

6. The dispenser of claim 1 wherein the actuating member includes a linearly translated push element which is translated upwardly to open the valve and is coupled to a pivoting member.

7. The dispenser of claim 1 wherein the tube extends through an opening in the body and the tube includes a retaining region having a cross-section larger than the opening.

8. The dispenser of claim 7 wherein the tube includes vent openings.

9. The dispenser of claim 8 wherein the vent openings are in the retaining region.

10. The dispenser of claim 9 wherein the vent openings are upwardly oriented.

11. The dispenser of claim 1 wherein the tube is about 4 to about 6 inches long.

12. The dispenser of claim 1 wherein the body includes two pieces about the beverage pathway lumen.

13. The dispenser of claim 1 wherein the shelf assembly is adapted to receive a bag-in-box container.

14. The dispenser of claim 1 wherein the shelf assembly includes a cabinet with a door disposed opposite the valve.

15. The dispenser of claim 12 wherein the shelf assembly includes a support stand, outside a refrigerated space.

16. A beverage dispenser, comprising:

a cabinet adapted to receive a bag-in-box container and a shelf assembly at a bottom of the container for supporting the container, the container having a bottom and a first side, the container including a gravity fed piston valve extending from the first side of the container, wherein the valve can be controllably opened and closed to dispense beverage from the container in a generally downward direction, a valve actuator coupled to the valve including a valve body attached to the cabinet below the valve, and a beverage pathway lumen extending through the valve body to direct beverage from the valve to a receptacle during dispensing, wherein the beverage pathway is defined by a tube removably attached to the valve, and the tube extends through an opening in the valve body and the tube includes a retaining region having a cross-section larger than the opening.

17. The dispenser of claim 16 wherein the tube includes vent openings.

18. The dispenser of claim 17 wherein the vent openings are in the retaining region.

19. The dispenser of claim 16 wherein the vent openings are upwardly oriented.

20. The dispenser of claim 19 wherein the tube is about 4 to about 6 inches long.

21. The dispenser of claim 20 wherein the body includes two pieces about the beverage pathway lumen.

22. The dispenser of claim 16 wherein the actuator has a pivoting element extending below the valve, the pivoting member including an upper member engaging the valve and a lower member which can be moved to actuate the valve.

23. The dispenser of claim 22 wherein the lower member is adapted to receive the beverage receptacle.

24. The dispenser of claim 21 wherein the pivoting element is a lever-form.

25. The dispenser of claim 22 wherein the actuating member includes a linearly translated push member which is translated upwardly to open the valve and is coupled to the pivoting member.

26. The dispenser of claim 16 wherein the shelf assembly includes a cabinet with a door.

27. The dispenser of claim 16 wherein the shelf assembly includes a support stand housing a refrigeration unit.

28. A beverage dispenser, comprising:

a beverage cabinet including a shelf assembly for support of a bulk beverage container, the container having a bottom and a first side, the container including a mechanically operable, gravity-fed piston valve extending from the first side of the container, wherein the valve can be controllably opened and closed to dispense beverage in a generally downward direction, and a valve actuator supported on the shelf assembly and coupled to the valve, wherein the actuator includes a body attached to the shelf and to which the pivoting element is articulated, a beverage pathway tube extending through said body.

29. The dispenser of claim 28 comprising an access door defining a cabinet wall opposite the valve.

30. The dispenser of claims 29 wherein the actuator has a pivoting element extending below the valve, the pivoting including an upper member engaging the valve and a lower member which can be moved to actuate the valve.

31. The dispenser of claim 30 wherein the lower member is adapted to receive the beverage receptacle.

32. The dispenser of claim 31 wherein the pivoting element is a lever-form.

33. The dispenser of claim 31 wherein the actuating member includes a linearly translated push element which is translated upwardly to open the valve and is coupled to the pivoting member.

* * * * *